US011415138B2

(12) United States Patent
Ye et al.

(10) Patent No.: US 11,415,138 B2
(45) Date of Patent: Aug. 16, 2022

(54) INTERMEDIATE BEARING IN ELECTRICAL SUBMERSIBLE PUMP

(71) Applicant: Baker Hughes Oilfield Operations LLC, Houston, TX (US)

(72) Inventors: Zheng Ye, Claremore, OK (US); Risa Rutter, Claremore, OK (US); Ryan Anthony Lack, Broken Arrow, OK (US); Jason Ives, Broken Arrow, OK (US)

(73) Assignee: BAKER HUGHES OILFIELD OPERATIONS, LLC, Houston, TX (US)

( * ) Notice: Subject to any disclaimer, the term of this patent is extended or adjusted under 35 U.S.C. 154(b) by 77 days.

(21) Appl. No.: 16/985,877

(22) Filed: Aug. 5, 2020

(65) Prior Publication Data

US 2021/0048029 A1 Feb. 18, 2021

Related U.S. Application Data

(60) Provisional application No. 62/885,649, filed on Aug. 12, 2019.

(51) Int. Cl.

| | |
|---|---|
| ***F04D 13/10*** | (2006.01) |
| ***F04D 1/10*** | (2006.01) |
| ***F04D 29/041*** | (2006.01) |

(52) U.S. Cl.

CPC ..... *F04D 13/10* (2013.01); *F04D 1/10* (2013.01); *F04D 29/0413* (2013.01)

(58) Field of Classification Search

CPC . F04D 13/08; F04D 13/10; F04D 1/06; E21B 43/128

See application file for complete search history.

(56) References Cited

U.S. PATENT DOCUMENTS

| | | | | |
|---|---|---|---|---|
| 3,238,879 | A * | 3/1966 | Shallenberg | F04D 13/10 415/131 |
| 5,209,577 | A * | 5/1993 | Swatek | F16C 33/043 384/97 |
| 6,424,066 | B1 * | 7/2002 | Watson | F04D 29/047 175/92 |
| 6,956,310 | B1 | 10/2005 | Knox | |
| 8,987,957 | B2 * | 3/2015 | Knapp | H02K 5/167 310/87 |
| 9,127,683 | B2 * | 9/2015 | Knapp | H02K 5/1677 |

(Continued)

OTHER PUBLICATIONS

International Seach Report and Written Opinion of PCT Application No. PCT/US2020/045761 dated Nov. 27, 2020: pp. 1-10.

*Primary Examiner* — Brian P Wolcott
*Assistant Examiner* — Jackson N Gillenwaters
(74) *Attorney, Agent, or Firm* — Bracewell LLP; Constance G. Rhebergen; Keith R. Derrington

(57) ABSTRACT

A submersible well fluid pump has diffusers non-rotatably mounted in a pump housing. A drive shaft rotates an impeller between each of the diffusers. A bearing is positioned between and in abutment with two of the diffusers. An annular recess encircles an outer wall of the bearing. A wave spring has undulations with inward protruding indentations in contact with a base of the recess and outward protruding indentations in engagement with an inner wall of the housing. The wave spring is split and radially compressed between the base of the recess and the housing inner wall.

20 Claims, 6 Drawing Sheets

(56) References Cited

U.S. PATENT DOCUMENTS

| | | | | |
|---|---|---|---|---|
| 9,438,089 | B2 | 9/2016 | Perisho et al. | |
| 10,145,380 | B1 | 12/2018 | Davis et al. | |
| 11,088,593 | B2 * | 8/2021 | Clingman | H02K 5/24 |
| 2012/0263610 | A1 | 10/2012 | Tetzlaff et al. | |
| 2016/0208848 | A1 * | 7/2016 | Swanson | F16C 17/042 |
| 2018/0291917 | A1 | 10/2018 | Webster et al. | |
| 2020/0362859 | A1 * | 11/2020 | Rutter | E21B 43/128 |

* cited by examiner

INTERMEDIATE BEARING IN ELECTRICAL SUBMERSIBLE PUMP

CROSS REFERENCE TO RELATED APPLICATION

This application claims priority to provisional application 62/885,649, filed Aug. 12, 2019.

FIELD OF THE DISCLOSURE

This disclosure relates in general to electrical submersible well pumps (ESP), particularly to a radial support bearing located between top and bottom bearings, the radial support bearing having a radially compressible ring biased against an inner surface of the pump housing.

BACKGROUND

Electrical submersible well pumps are often used to pump liquids from hydrocarbon producing wells. A typical ESP includes a pump driven by an electrical motor. The pump is often a centrifugal type with numerous stages, each stage having an impeller and a diffuser. Top and bottom bearings provide the radial support for the shaft in the pump. The top and bottom bearings are rigidly mounted to the housing of the pump. The diffusers are stacked together and slide into the bore of the housing during assembly. An elastomeric seal, normally an O-ring, may be on the outer diameters of the diffusers. The O-rings seal to the inside surface of the housing, preventing leakage of fluid through the small annular clearances between the outer diameters of the diffusers and the housing.

These pumps can be quite lengthy, up to 30 feet, thus slight off-center misalignment of the portion of the shaft between the top and bottom bearings can occur. Eccentric portions of the shaft can lead to orbiting and bearing side load. The resulting vibration can be particularly a problem with high speed pumps, as it can create heat much more so than at normal speed. The heat can damage the pump components, leading to failure.

SUMMARY

A submersible well fluid pump comprises a tubular pump housing having a longitudinal axis and a bore with a housing inner wall. A rotatable shaft extends along the axis. The pump has a plurality of stages, each stage having a diffuser non-rotatably mounted in the housing and an impeller that rotates with the shaft. A top bearing through which the shaft extends mounts to the housing inner wall above the stages. A bottom bearing through which the shaft extends mounts to the housing inner wall below the stages. An intermediate bearing mounts in the housing between the top bearing and the bottom bearing and is non-rotatable relative to the housing. The intermediate bearing has a bearing outer wall with a metal spring radially biased against the housing inner wall.

The intermediate bearing in some embodiments is positioned between one of the diffusers and one of the impellers. The intermediate bearing has a hub having a hub bore through which the shaft extends, the hub being surrounded by the bearing outer wall. A support extends between the hub and the bearing outer wall. A flow passage extends between the hub and the bearing outer wall for well fluid to flow through the intermediate bearing. An annular recess encircles the bearing outer wall in the embodiment shown. The spring is located in the recess.

A next lower one of the impellers is located directly below the intermediate bearing. A next upper one of the diffusers abuts an upper end of the bearing outer wall. In one embodiment shown, a lower portion of the bearing outer wall surrounds an upper portion of the next lower one of the impellers. The next upper one of the diffusers has a lower end in abutment with the bearing outer wall. An anti-rotation member may extend between the bearing outer wall and one of the diffusers.

A bearing sleeve may be mounted in the hub for rotation with the shaft. The bearing sleeve has a lower end in abutment with the next lower one of the impellers and is axially movable relative to the shaft. A non-rotating downward-facing up thrust surface is in a diffuser bore of the next upper one of the diffusers. During up thrust, the next lower one of the impellers pushes the bearing sleeve upward into engagement with the up thrust surface for transferring up thrust to the next upper one of the diffusers. In one embodiment, the up thrust surface is on a bushing fixed within a next upper one of the diffusers.

In one embodiment, the intermediate bearing comprises one of the diffusers. This diffuser serves as a radial bearing and also has diffuser passages for well fluid that extend inward and upward.

In the embodiments shown, the spring has an undulating configuration. More particularly, the spring comprises a wave spring having undulations with inward protruding indentations in contact with the bearing outer wall and outward protruding indentations in engagement with the housing inner wall. The wave spring is split and radially compressed between the bearing outer wall the housing inner wall.

DETAILED DESCRIPTION OF THE DISCLOSURE

Figure 1:
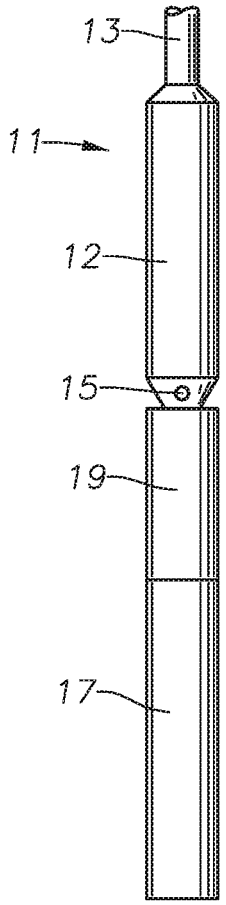
FIG. 1 is a schematic side view of an electrical submersible pump in accordance with this disclosure and installed in a well.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude. The terms "upper" and "lower" and the like bare used only for convenience as the well pump may operate in positions other than vertical, including in horizontal sections of a well.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, an electrical well pump assembly (ESP) 11 of a type typically used for oil well pumping operations is illustrated. ESP 11 includes a centrifugal pump 12. ESP 11 may be suspended in a well on a string of production tubing 13. Pump 12 has an intake 15 and discharges into production tubing 13 in this example. Alternately, ESP 11 could be suspended on coiled tubing, in which case pump 12 would discharge into the annulus surrounding the coiled tubing.

ESP 11 also includes an electrical motor 17 for driving pump 12. Motor 17 connects to pump 12 via a seal section 19, which may have means for reducing a pressure differential between lubricant within motor 17 and the hydrostatic pressure of well fluid in the well. Intake 15 may be at the lower end of pump 12, in the upper end of seal section 19, or in a separate module. Also, ESP 11 may also include a gas separator, and if so intake 15 would be in the gas separator. In this embodiment, motor 17 is located below pump 12. If ESP 11 is suspended on coiled tubing, motor 17 would normally be above pump 12.

Figure 2:
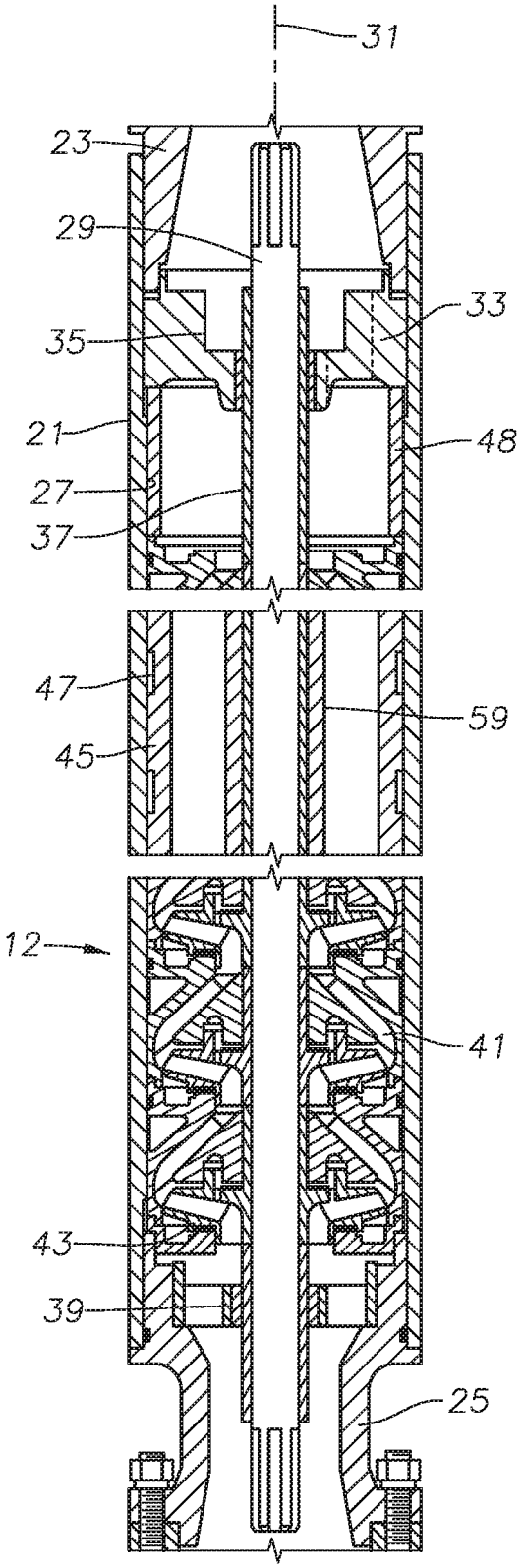
FIG. 2 is an axial sectional and partly schematic view of portions of the pump of the electrical submersible pump of FIG. 1.

Referring to FIG. 2, pump 12 has a tubular housing 21 that includes an upper connector 23 on its upper end and lower connector 25 on its lower end. Connectors 23 are secured by threads to housing 21, but may be considered to be a part of housing 21. In this example, upper connector 23 connects to a discharge member (not shown), which in turn secures to production tubing 13. Lower connector 25 connects to seal section 19 (FIG. 1). Connectors 23, 25 are illustrated to be a bolted type; alternately, they could have rotatable threaded collars.

Housing 21 has a bore that defines a cylindrical inward-facing housing inner wall 27. A shaft 29 extends through the bore of housing 21 along a longitudinal axis 31. A top bearing 33 provides radial stabilization for an upper portion of shaft 29. Top bearing 33 may be conventional, having a non-rotating bushing 35 in rotating sliding engagement with a sleeve 37 on shaft 29. A key (not shown) engages mating grooves in shaft 29 and sleeve 37, causing sleeve 37 to rotate with shaft 29. Top bearing 33 has well fluid flow passages indicated by the dotted lines in FIG. 2.

A bottom bearing 39 provides radial stabilization for a lower portion of shaft 29. Bottom bearing 39 may also be conventional. In this example, bottom bearing 39 mounts within a bore in lower connector 25.

Pump stages are mounted in housing 21 between top bearing 33 and bottom bearing 39. Each pump stage includes a diffuser 41 and an impeller 43. Diffusers 41 are stacked together in a stack and do not rotate within housing 21. Each impeller 43 locates between two of the diffusers 41 and is keyed to shaft 29 for rotation in unison.

An intermediate bearing 45 in housing 21 about halfway between top bearing 33 and bottom bearing 39 provides radial stabilization for a central portion of shaft 29. The length of shaft 29, which may be up to 30 feet, may justify more than one intermediate bearings 45. If so, the spacing between intermediate bearings 45 may vary, such as between two and fifteen feet. Intermediate bearing 45 is secured within the stack of diffusers 41 for non-rotation. Intermediate bearing 45 has on its outer diameter at least one annular spring recess 47 for receiving a radially compressible spring (not visible in FIG. 2) that is biased against housing inward-facing wall 27. In this example, intermediate bearing 45 has two spring recesses 47, each containing a spring.

Axial compression will be applied to the stack of diffusers 41 and intermediate bearing 45 during assembly, preventing the stack from rotating relative to housing 21. The compressive preload may be applied in various manners. In this embodiment, top bearing 33 has external threads secured to internal threads in housing 21. Tightening top bearing 33 exerts a downward compressive force through a compression ring 48 to the stack of diffusers 41. The compressive force passes through the stack of diffusers 41 to lower connector 25. The compressive force also passes through intermediate bearing 45, because it forms a part of the stack.

Figure 3:
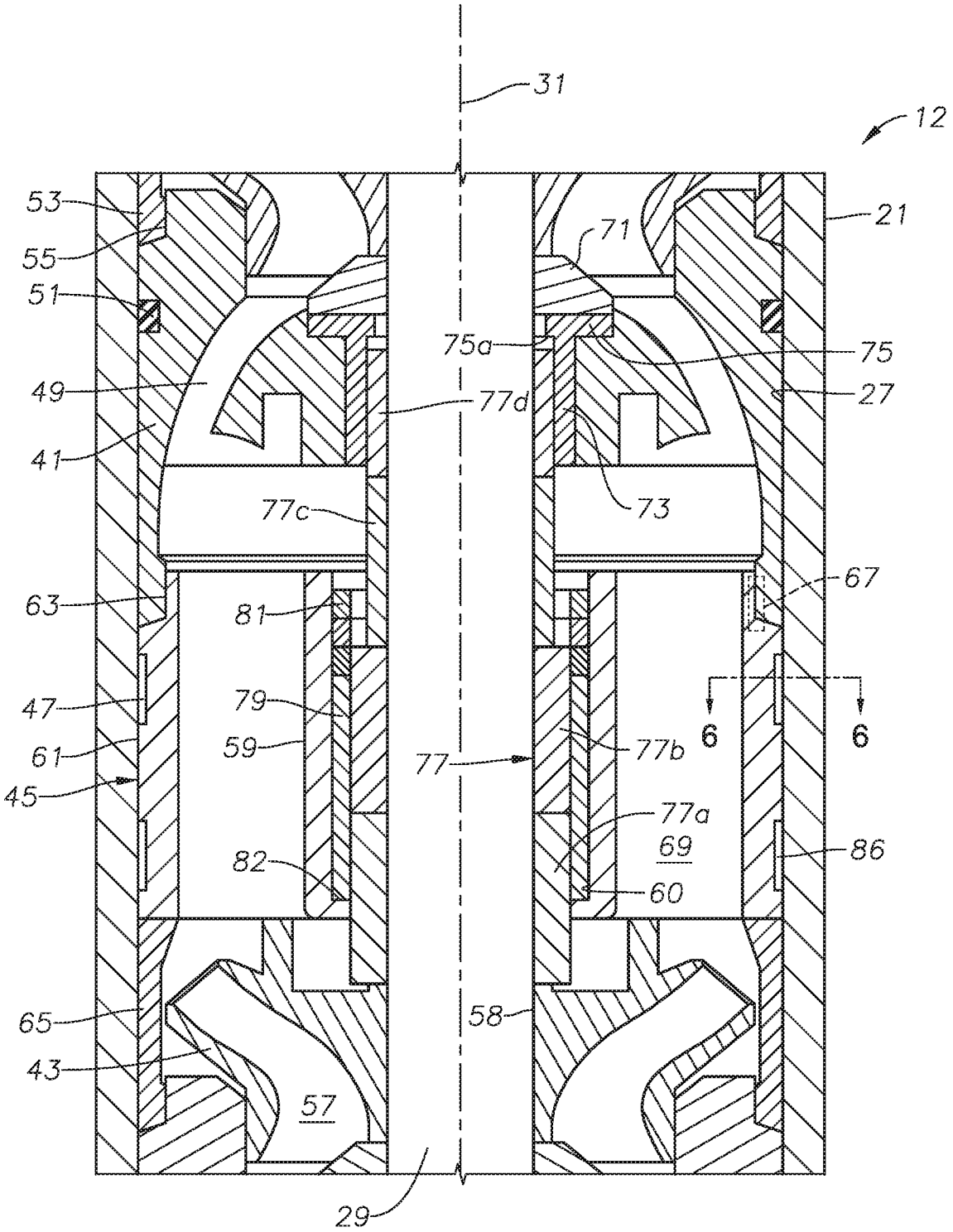
FIG. 3 is an enlarged axial sectional view of portions of the pump of FIG. 2, illustrating an intermediate bearing.

FIG. 3 shows one of the diffusers 41 in more detail, and all of the diffusers 41 in the stack may be identical. Diffuser 41 has diffuser passages 49 that curve upward and inward in a conventional manner. Diffuser 41 may have an elastomeric O-ring seal 51 in an annular groove on its outward-facing wall. O-ring seal 51 seals against housing inward-facing wall 27, preventing leakage in the small annular clearance between the outer diameter of diffuser 41 and inward-facing wall 27. Diffuser 41 has a depending annular lip 53 on its lower end that nests in an annular recess 55 on the upper end of the next lower diffuser 41.

Impellers 43 may be identical, and one is shown in more detail in FIG. 2. Impeller 43 has impeller passages 57 that curve upward and outward in a conventional manner. Impeller 43 has a bore 58 through which shaft 29 passes. A key (not shown) engages mating grooves in impeller bore 58 and on shaft 29 for causing impeller 43 to rotate with shaft. In this embodiment, impellers 43 are free to float or move short axial distances relative to shaft 29 and diffusers 41.

Intermediate bearing 45 has a hub 59 with a hub bore 60 through which shaft 29 passes. Hub bore 60 is considerably larger in inner diameter than the outer diameter of shaft 29. Intermediate bearing 45 has a concentric outer wall 61 with an upper annular recess 63 on its upper end. Intermediate bearing recess 63 faces outward for receiving diffuser lip 53 of the next upper diffuser 41. The outer diameter of intermediate bearing 45 is no greater than the outer diameters of diffusers 41 because the entire stack of diffusers 41, including intermediate bearing 45, must be pushed into housing 21 during assembly. A typical transverse width of the clearance between the stack of diffusers 41 and housing inward-facing wall 27 is about 0.005 inch on a side.

In this embodiment, a spacer sleeve 65 fits between the lower end of intermediate bearing outer wall 61 and the diffuser recess 55 of the next lower diffuser 41. Spacer sleeve 65 surrounds the an upper portion of the next lower impeller 43. Spacer sleeve 65 could be integrally formed with intermediate bearing outer wall 61, thus it may be considered to be a lower portion of bearing outer wall 61. The lower portion of spacer sleeve 65 has the same configuration as diffuser lip 53 for mating with diffuser recess 55 of the next lower diffuser.

Because of the axial compression of the stack of diffusers 41, intermediate bearing 45 is non-rotatable relative to pump housing 21. In addition, an anti-rotation feature between intermediate bearing 45 and adjacent diffusers 41 may be employed. In this example, the anti-rotation feature comprises an anti-rotation pin and mating circular holes 67 in intermediate bearing upper recess 63 and the lip 53 of the next upper diffuser 41.

The next lower impeller 43 discharges well fluid into intermediate bearing flow passage 69 in intermediate bearing 45 between hub 59 and outer wall 61. Intermediate bearing flow passages 69 are parallel with axis 31, not curved like diffuser passages 49. Impellers 43 create down thrust as they discharge well fluid. In this example, the down thrust from one of the impellers 43 transfers through a thrust runner 71, which rotates with impeller 43, to a diffuser bushing 73 mounted for non-rotation within a receptacle in the next lower diffuser 41. The down thrust transfers through the stack of diffusers 41, including intermediate bearing outer wall 61, to lower connector 25 (FIG. 2).

In this embodiment, diffuser bushing 73 has a flange 75 on its upper end that is engaged by runner 71. Flange 75 has an inner portion 75*a* that extends inward a short distance past the inner diameter of the cylindrical portion of diffuser bushing 73. Inner portion 75*a* defines a downward-facing shoulder in diffuser bushing 73.

Up thrust may also occur from time-to time, causing impellers 43 to move upward a short distance on shaft 29. In the FIG. 3 embodiment, the up thrust from the next lower impeller 43 transfers through intermediate bearing 45 to the next upper diffuser 41. In FIG. 3, a bearing sleeve 77 transfers the up thrust. Bearing sleeve 77 optionally may comprise multiple sleeves 77*a*, 77*b*, 77*c* and 77*d* stacked on each other and keyed to shaft 29 for rotation. In this example, the upper two sleeves 77*c* and 77*d* have a lesser thickness measured between inner and outer diameters than the lower two sleeves 77*a*, 77*b*. Lower sleeves 77*a*, 77*b* are located within hub bore 60, and sleeve 77*c* has a lower portion within hub bore 60. Sleeve 77*c* has an upper portion that protrudes upward from intermediate bearing hub 59.

Uppermost sleeve 77*d* fits within the bore of diffuser bushing 73 in rotating sliding contact. During down thrust, the upper end of sleeve 77*d* is a short distance below flange inner portion 75*a*, which comprises an up thrust surface. During up thrust, the upper end of sleeve 77*d* will abut and slide against the downward-facing side of flange inner portion 75*a*, transferring up thrust to the diffuser 41 directly above intermediate bearing 45.

Sleeves 77*a* and 77*b* are in sliding rotational engagement with a non-rotating bushing 79 in hub 59. Retainer rings 81 (three shown) secure bushing 79 in hub 59. Retainer rings 81 are in an interference fit with the inner diameter of hub 59. The lower end of bushing 79 engages an upward-facing shoulder 82 in hub 59.

Intermediate bearing sleeves 77*a* and 77*b* are much thicker in transverse width from the inner to the outer diameters than sleeve 77*c* and diffuser sleeve 77*d*. In this example, the transverse width of intermediate bearing sleeves 77*a* and 77*b* is about one-half to two-thirds greater than the transverse width of sleeve 77*c* and diffuser sleeve 77*d*. The greater thickness is desirable, particularly because of erosion and abrasion that occurs in abrasive well fluid conditions. Runner 71, bushings 73, 79 and sleeves 77*a*, 77*b*, 77*c* and 77*d* may be formed of a hard, wear resistant material such as tungsten carbide. Also, as noted above, one or more of sleeves 77*a*, 77*b*, 77*c* and 77*d* may be integrally formed with others of the sleeves as a single monolithic piece.

Figure 4:
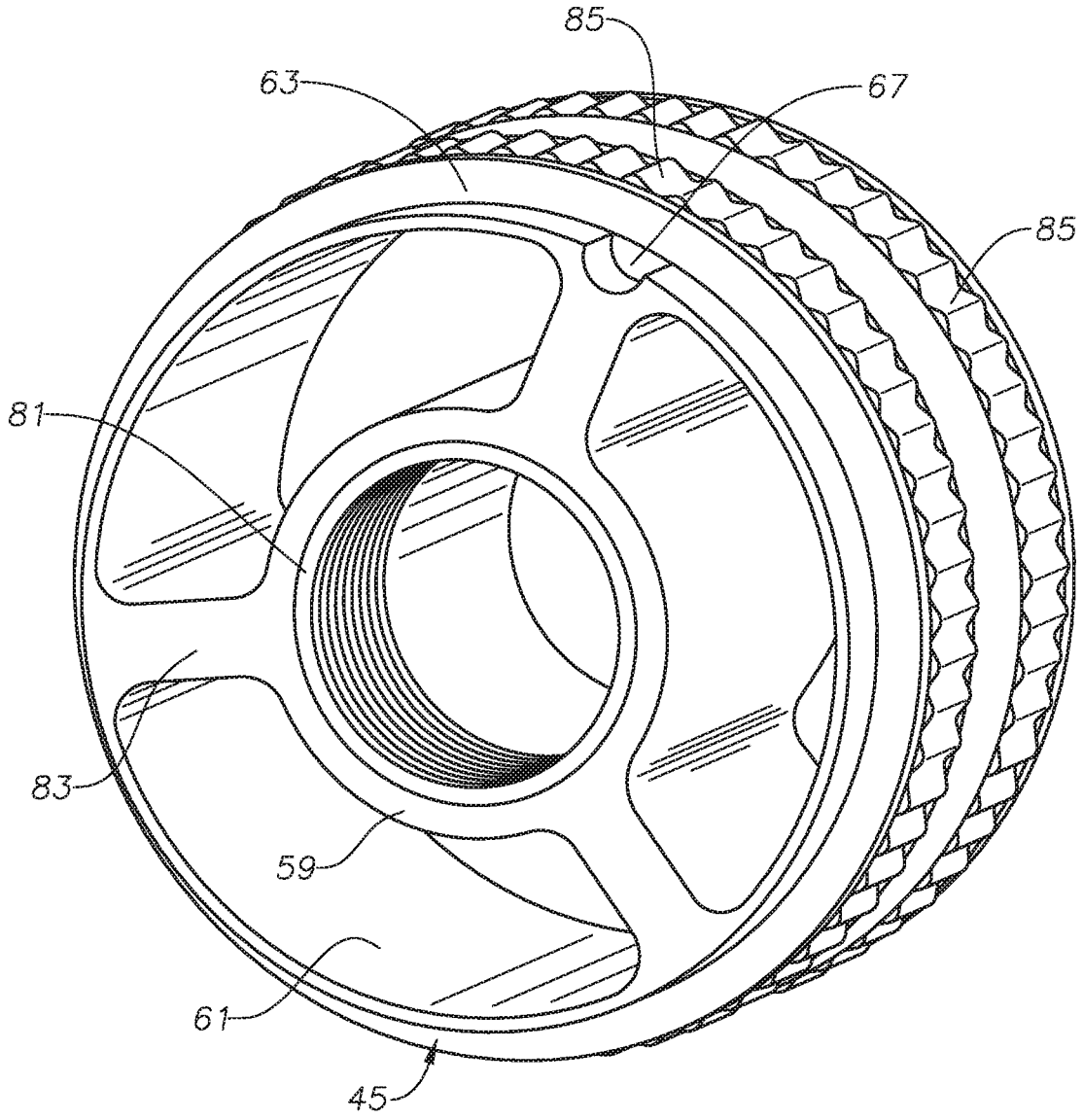
FIG. 4 is a perspective view of the intermediate bearing of FIG. 2, shown removed from the pump.
Figure 5:
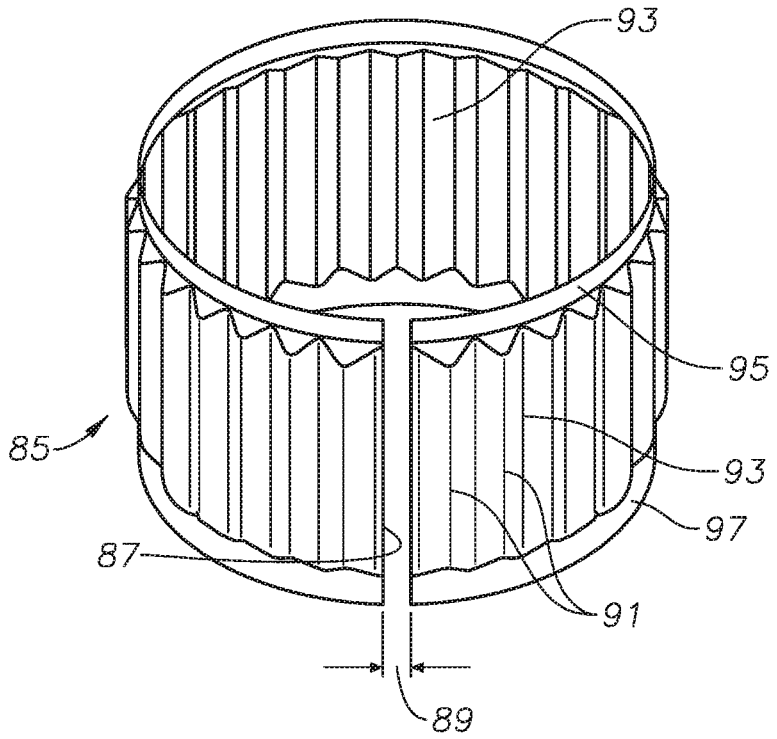
FIG. 5 is a perspective view of the radial compression spring of the intermediate bearing of FIG. 4, shown removed from the intermediate bearing.
Figure 6:
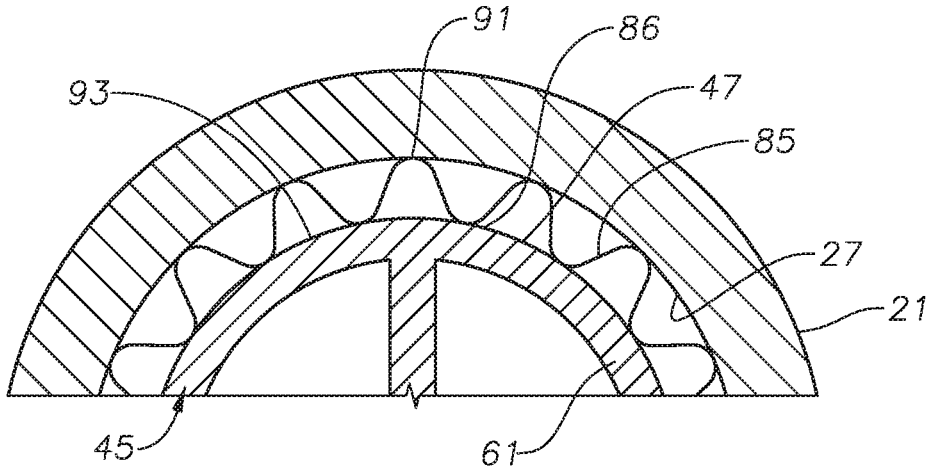
FIG. 6 is a schematic transverse sectional view of a portion of the intermediate bearing, taken along the line 6-6 of FIG. 3.

Referring to FIG. 4, radially extending support arms or spokes 83 join outer wall 61 with hub 59. The spaces between support arms 83 define flow passages 69 (FIG. 3). Radially compressible springs, also referred to herein as wave springs 85, are located in each spring recess 47 (FIG. 6). As illustrated in FIG. 6, each wave spring 85 is resilient and compressible between its inner and outer diameters. Each wave spring 85 is in frictional engagement with the cylindrical base 86 of one of the intermediate bearing recesses 47 and with housing inward-facing wall 27. Referring also to FIG. 5, wave spring 85 is split having two ends 87 that are separated from each other by a gap 89 once installed in recess 47. Wave spring 85 has outward protruding indentations 91 that exert an outward bias force against housing inward-facing wall 27. Wave spring 85 has inward protruding indentations 93 that exert an inward bias force against intermediate bearing outer wall 61.

Prior to installation in intermediate bearing recess 47, wave spring 85 has a radial or transverse width from its circumscribed outer diameter at outward protruding indentations 91 to its circumscribed inner diameter at inward protruding indentations 93 that is greater than the radial distance from recess base 86 to housing inward-facing wall 27. Prior to installation in housing 21, the circumscribed outer diameter of outward protruding indentations 91 is greater than the inner diameter of housing inward-facing wall 27. The resiliency of wave spring 85 and end gap 89 enable it to be resiliently expanded over intermediate bearing outer wall 61 and snapped into recess 47. The resiliency also deflects the radial width of wave spring 85, causing it to fit tightly between base 86 of recess 47 and housing inward-facing wall 27. The deflection is elastic, less than the yield strength of the material of wave spring 85.

Each wave spring 85 has an axial dimension that is only slightly less than the axial dimension of recess 47. Referring to FIG. 5, wave spring 85 is formed of a metal, such as a spring steel. One example of a suitable metal is Hastelloy. Wave spring 85 is a curved strip that is formed into a partially cylindrical shape with end gap 89 between its ends 87. In the example shown, wave spring 85 has a circumferentially extending upper band 95 formed on its upper side and a circumferentially extending lower band 97 formed on its lower side.

Outward-protruding waves or indentations 91 are permanently formed in wave spring 85, creating convex shapes extending around wave spring 85. Outward-protruding indentations 91 extend from upper band 95 to lower band 97 and are parallel with axis 31 (FIG. 3). Each indentation 91 is elongated, having a length greater than its width. Each inward-protruding indentation 93 is located between two of the outward-protruding indentation 91, creating concave shapes on the exterior of wave spring 85. Inward-protruding indentations 93 are identical to outward-protruding indentations 91 in length and width. Each inward-protruding indentation 93 protrudes radially inward from upper and lower bands 95, 97 the same radial distance as each outward-protruding indentation 91. When viewed in cross-section, as in FIG. 6, outward and inward protruding indentations 91, 93 define an undulating sinusoidal configuration. Other types of radially compressible springs are feasible.

Figure 7:
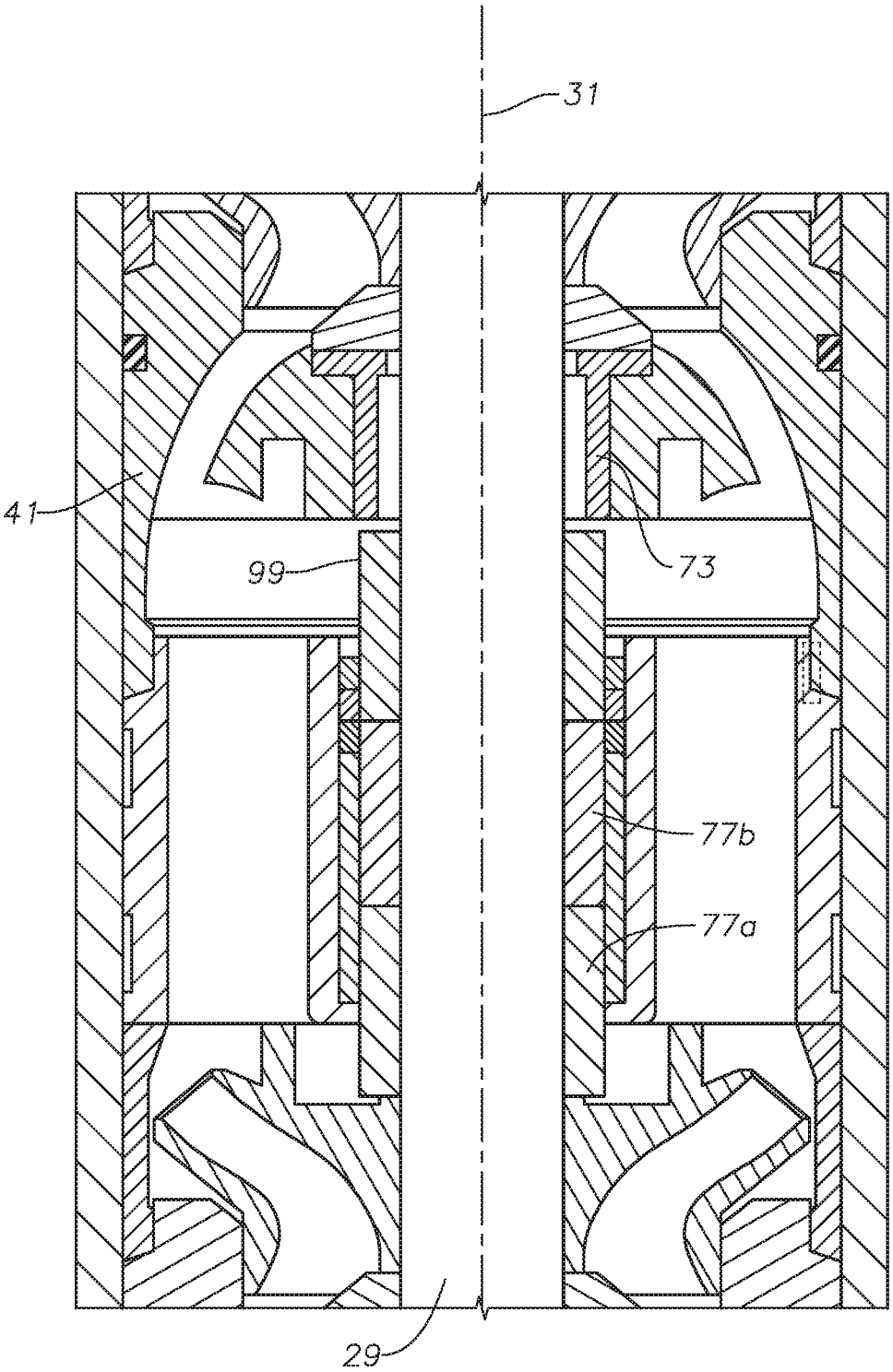
FIG. 7 is a sectional view similar to FIG. 3, but showing an alternate arrangement for handling up thrust from the impeller directly below the intermediate bearing.

Referring to the alternate embodiment of FIG. 7, components mentioned that are the same as in FIG. 3 have the same numerals. The embodiment of FIG. 7 differs from the embodiment of FIG. 3 in how up thrust is transferred. In FIG. 7, rotating sleeves 77*a* and 77*b* are the same as in FIG. 3. A sleeve 99 replaces sleeves 77*c* and 77*d* of FIG. 3 and also rotates in unison with shaft 29. Sleeve 99 may be identical to sleeves 77*a* and 77*b*, having the same thickness from the inner to the outer diameters. Sleeve 99 may have the same axial dimension as sleeve 77*c* (FIG. 3), but can be thicker, with an outer diameter greater than the inner diameter of diffuser bushing 73.

During down thrust, the upper end of sleeve 99 will be spaced below the lower end of diffuser bushing 73. The lower end of diffuser bushing 73 comprises an up thrust surface. During up thrust, the upper end of sleeve 99 bears against the lower end of diffuser bushing 73, transferring up thrust to diffuser 41. In this example, unlike diffuser sleeve 77*d* (FIG. 3), there is no rotating sleeve within the inner diameter of diffuser bushing 73.

Figure 8:
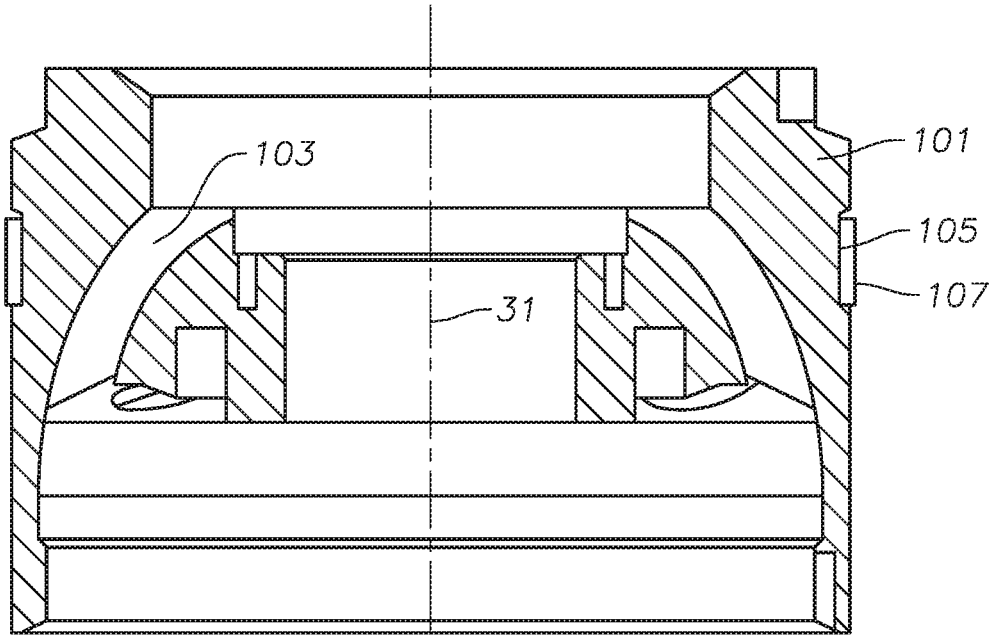
FIG. 8 is a simplified sectional of an alternate embodiment of one of the diffusers, the alternate embodiment being a diffuser bearing having a radial compression ring and serving as an intermediate bearing.

Another embodiment of an intermediate bearing is illustrated in FIG. 8. In this embodiment, one or more of the diffusers 41 (FIG. 3) serve also as an intermediate bearing for shaft 29. Diffuser bearing 101 performs the same functions as diffusers 41, having curved flow passages 103 that deliver well fluid from a next lower impeller 43 (FIG. 3) to a next upper impeller 43.

Figure 9:
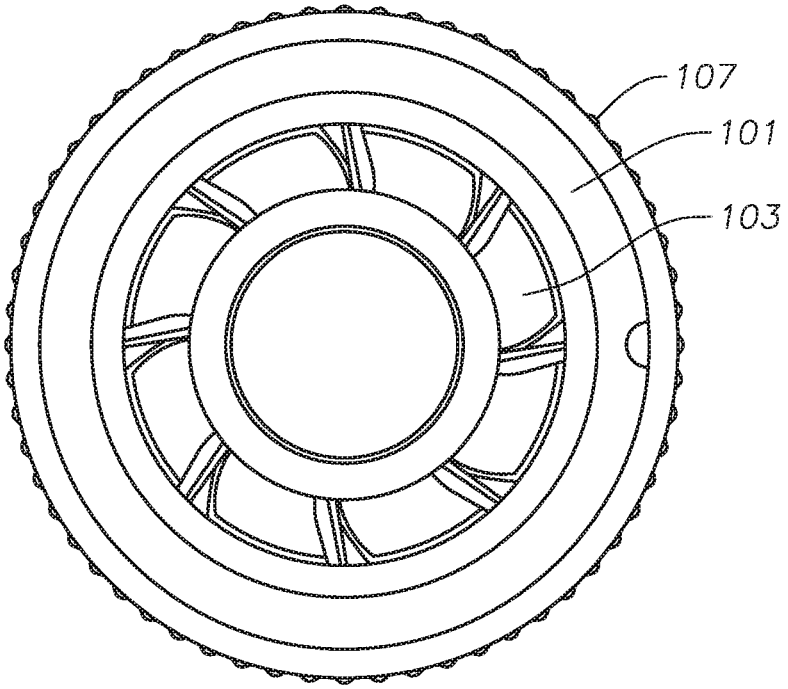
FIG. 9 is a top view of the diffuser bearing of FIG. 8.

Diffuser bearing 101 has all of the same features as one of the diffusers 41 except O-ring seal 51 (FIG. 3). Instead, it has an annular recess 105 located approximately where the groove for O-ring seal 51 is normally located. Annular recess 105 holds a wave spring 107 that may be identical to wave spring 85 (FIGS. 4-6). Wave spring 107 operates in the same manner as wave spring 85, providing a radial compressive force between housing inward-facing wall 27 (FIG. 3) and the outer wall of diffuser bearing 101. As illustrated in FIG. 9, prior to installing diffuser bearing 101, outward protruding indentations of wave spring 107 will circumscribe a greater outer diameter than diffuser bearing 101 and also greater than the inner diameter of housing inward-facing wall 27 (FIG. 3).

Pump 12 (FIG. 2) may have one or more diffuser bearings 101 plus conventional diffusers 41 and one or more intermediate bearings 45. Alternately, pump 12 may contain only one or more diffuser bearings 101 along with conventional diffusers 41. The spacing between diffuser bearings 101 may vary, such as from two to fifteen feet.

The present invention described herein, therefore, is well adapted to carry out the objects and attain the ends and advantages mentioned, as well as others inherent therein. While only a few embodiments of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A submersible well fluid pump, comprising:

a tubular pump housing having a longitudinal axis and a bore with a housing inner wall;

a rotatable shaft extending along the axis;

a plurality of stages, each stage having a diffuser non-rotatably mounted in the housing and an impeller that rotates with the shaft;

a top bearing through which the shaft extends, the top bearing being mounted to the housing inner wall above the stages;

a bottom bearing through which the shaft extends, the bottom bearing being mounted to the housing inner wall below the stages; and an intermediate bearing mounted in the housing between the top bearing and the bottom bearing, the intermediate bearing being non-rotatable relative to the housing and having a bearing outer wall with an annular recess encircling the bearing outer wall, and a metal spring in the recess and that is radially biased against the housing inner wall.

2. The pump according to claim 1, wherein the spring has an undulating configuration.

3. The pump according to claim 1, wherein:

the intermediate bearing is positioned between one of the diffusers and one of the impellers.

4. The pump according to claim 1, wherein the intermediate bearing comprises:

a hub having a hub bore through which the shaft extends, the hub being surrounded by the bearing outer wall;

a support extending between the hub and the bearing outer wall, the support defining a flow passage between the hub and the bearing outer wall for well fluid to flow through the intermediate bearing.

5. The pump according to claim 4, wherein:

a next lower one of the impellers is located directly below the intermediate bearing; and a next upper one of the diffusers abuts an upper end of the bearing outer wall.

6. The pump according to claim 5, further comprising:

a lower portion of the bearing outer wall surrounds an upper portion of the next lower one of the impellers; and the next upper one of the diffusers has a lower end in abutment with the bearing outer wall.

7. The pump according to claim 5, further comprising:

an anti-rotation member extending between the bearing outer wall and one of the diffusers.

8. The pump according to claim 5, wherein:

the next lower one of the impellers is located directly below the intermediate bearing;

the next upper one of the diffusers abuts an upper end of the bearing outer wall; the assembly further comprising:

a bearing sleeve mounted in the hub for rotation with the shaft, the bearing sleeve having a lower end in abutment with the next lower one of the impellers and being axially movable relative to the shaft;

a non-rotating downward-facing up thrust surface in a diffuser bore of the next upper one of the diffusers; and wherein during up thrust, the bearing sleeve is pushed upward by the next lower one of the impellers into engagement with the thrust surface for transferring up thrust to the next upper one of the diffusers.

9. The pump according to claim 5, wherein:

the next lower one of the impellers is located directly below the intermediate bearing;

the next upper one of the diffusers has a lower end that abuts an upper end of the bearing outer wall; the assembly further comprising:

a bearing sleeve mounted in the hub for rotation with the shaft, the bearing sleeve being axially movable relative to the shaft and having a lower end in abutment with the next lower one of the impellers;

a non-rotating bushing fixed in a diffuser bore of the next upper one of the diffusers; and wherein during up thrust, the bearing sleeve is pushed upward by the next lower one of the impellers into engagement with the bushing to transfer the up thrust to the next upper one of the diffusers.

10. The pump according to claim 1, wherein:

the intermediate bearing comprises one of the diffusers, said one of the diffusers having diffuser passages for well fluid that extend inward and upward.

11. The pump according to claim 1, wherein the spring comprises:

a wave spring having undulations with inward protruding indentations in contact with the bearing outer wall and outward protruding indentations in engagement with the housing inner wall, the wave spring being split and radially compressed between the bearing outer wall the housing inner wall.

12. A submersible well fluid pump, comprising:

a tubular pump housing having a longitudinal axis and a bore with a housing inner wall facing the axis;

a rotatable shaft extending along the axis;

first and second diffusers non-rotatably mounted in the housing;

an impeller between the first and second diffusers, the impeller rotating with the shaft, each of the first and second diffusers having a diffuser outer wall closely received within the housing inner wall;

a bearing positioned between the first and second diffusers, comprising:

a bearing hub having a bore through which the shaft passes;

a bearing outer wall surrounding the bearing hub, the bearing outer wall having a first end in abutment with an end of the outer wall of the first diffuser and a second end in abutment with an end of the outer wall of the second diffuser;

an annular recess encircling the bearing outer wall, the recess having a base facing the housing inner wall;

a support member joining the bearing hub to the bearing outer wall and defining a flow passage between the bearing hub and the bearing outer wall for communicating well fluid from the impeller to one of the diffusers; and a wave spring having undulations with inward protruding indentations in contact with the base of the recess and outward protruding indentations in engagement with the housing inner wall, the wave spring being split and radially compressed between the base of the recess and the housing inner wall.

13. The pump according to claim 12, further comprising:

an anti-rotation member extending between the first end of the bearing outer wall and the end of the outer wall of the first diffuser.

14. The pump according to claim 12, wherein:

a lower portion of the bearing outer wall surrounds an upper portion of the impeller.

15. The pump according to claim 12, wherein the base of the recess is cylindrical.

16. The pump according to claim 12, further comprising:

a non-rotating diffuser bushing in the first diffuser through which the shaft passes, the diffuser bushing having an up thrust surface facing the impeller; and a bearing sleeve carried by the shaft within the bearing hub for rotation therewith, the bearing sleeve being axially movable on the shaft a limited amount, the bearing sleeve having a second end that abuts the impeller during down thrust and a first end that abuts the up thrust surface of the diffuser bushing during up thrust to transfer up thrust from the impeller to the first diffuser.

17. The pump according to claim 16, further comprising:

a bearing bushing mounted in the hub for non-rotation relative to the hub, the bearing bushing having an inner diameter in sliding rotational engagement with the bearing sleeve.

18. A submersible well fluid pump, comprising:

a tubular pump housing having a longitudinal axis and a bore with a housing inner wall;

a rotatable shaft extending along the axis;

a plurality of diffusers in a stack and secured for non-rotation within the housing inner wall, each of the diffusers having an outer wall closely received within the housing inner wall;

a plurality of impellers, each of the impellers being located between two of the diffusers and carried by the shaft for rotation therewith;

an annular recess encircling the outer wall of at least one of the diffusers; and a metal spring extending circumferentially around the recess and radially biased between said at least one of the diffusers and the housing inner wall.

19. The pump according to claim 18, wherein the spring has an undulating configuration.

20. The pump according to claim 18, wherein:

the recess has an outward facing base; and the spring comprises:

a wave spring having undulations with inward protruding indentations in contact with the base of the recess and outward protruding indentations in engagement with the housing inner wall, the wave spring being split and radially compressed between the base of the recess and the housing inner wall.

* * * * *